US009194076B2

(12) United States Patent
Son et al.

(10) Patent No.: US 9,194,076 B2
(45) Date of Patent: Nov. 24, 2015

(54) METHOD FOR CONTROLLING LAUNDRY MACHINE

(75) Inventors: Chang Woo Son, Changwon-si (KR); Sang Hun Bae, Changwon-si (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG ELECTRONICS INC., SeouL (KR)

( * ) Notice: Subject to any disclaimer, the term of this patent is extended or adjusted under 35 U.S.C. 154(b) by 0 days.

(21) Appl. No.: 13/024,752

(22) Filed: Feb. 10, 2011

(65) Prior Publication Data

US 2011/0138648 A1 Jun. 16, 2011

Related U.S. Application Data

(62) Division of application No. 11/980,788, filed on Oct. 31, 2007, now abandoned.

(30) Foreign Application Priority Data

Dec. 22, 2006 (KR) ..... 10-2006-0132429

(51) Int. Cl.
*D06F 58/20* (2006.01)

(52) U.S. Cl.
CPC ..... *D06F 58/203* (2013.01)

(58) Field of Classification Search
CPC ..... D06F 58/203
USPC ..... 34/486, 389, 390, 499
See application file for complete search history.

(56) References Cited

U.S. PATENT DOCUMENTS

| | | | | |
|---|---|---|---|---|
| 2,296,426 | A | 9/1942 | Coutant | |
| 4,519,145 | A | 5/1985 | Mandel | |
| 4,881,493 | A | 11/1989 | Riba | |
| 5,402,709 | A | 4/1995 | Carron et al. | |
| 5,675,911 | A | 10/1997 | Moser | |
| 2005/0034248 | A1 * | 2/2005 | Oh et al. | 8/149.3 |
| 2006/0005581 | A1 | 1/2006 | Banba | |
| 2006/0016020 | A1 | 1/2006 | Park | |
| 2007/0163098 | A1 * | 7/2007 | Tomasi et al. | 28/100 |
| 2007/0283509 | A1 * | 12/2007 | Wong et al. | 8/149.3 |

FOREIGN PATENT DOCUMENTS

| | | | |
|---|---|---|---|
| CN | 1711385 | | 12/2005 |
| DE | 103 32 656 | | 7/2004 |
| EP | 1 666 655 | A2 | 6/2006 |
| JP | 62238942 | A * | 10/1987 |
| JP | 06-233898 | | 8/1994 |
| JP | 2006141986 | | 6/2006 |
| JP | 2006-320410 | A | 11/2006 |
| KR | 1020060054887 | A | 5/2006 |
| WO | WO 2004/044302 | | 5/2004 |
| WO | WO 2006/101312 | A1 | 9/2006 |

* cited by examiner

*Primary Examiner* — Jiping Lu
(74) *Attorney, Agent, or Firm* — Dentons US LLP

(57) ABSTRACT

Method for controlling a dryer having a steam generator for generating high temperature steam with heat generation of a steam heater, including a hot air supply step for supplying dried hot air to a drum for drying clothes, and a moisture supply step for supplying moisture to the drum for removing static electricity from the clothes dried in the hot air supply step.

13 Claims, 7 Drawing Sheets

METHOD FOR CONTROLLING LAUNDRY MACHINE

CROSS-REFERENCE TO RELATED APPLICATIONS

This application is a divisional application of U.S. patent application Ser. No. 11/980,788, filed Oct. 31, 2007 now abandoned, which claims priority to Korean Application No. 10-2006-0132429, filed on Dec. 22, 2006, all of which are incorporated by referenced in their entirety herein.

BACKGROUND OF THE INVENTION

1. Field of the Invention

The present invention relates to a method for controlling a laundry machine, and more particularly, to a laundry dryer having a function for preventing wrinkles or static electricity from forming on clothes.

2. Discussion of the Related Art

In general, laundry dryers are electric appliances that dry washed laundry, mainly washed clothes, by using high temperature air.

In general, the laundry dryer is provided with a drum, a driving source for driving the drum, heating means for heating air introduced to the drum, and a blower unit for drawing/discharging air from/to the drum.

In the dryers, there are electric type dryers and gas type dryers depending on air heating systems, i.e., the heating means. The electric type dryers heat the air with heat from electric resistance, and the gas type dryers heat the air with heat from combustion of gas.

The dryers may also be sorted as condensing type dryers and exhaust type dryers. In the condensing type dryer, the humid air having heat exchanged with an drying object in the drum is, not discharged to an outside of the dryer, but circulated in the dryer, and heat exchanged with external air at a condenser provided separately to form condensed water which is discharged to an outside of the dryer. In the exhaust type dryer, the humid air having heat exchanged with the drying object in the drum is discharged to an outside of the dryer, directly.

The dryers may also be sorted as top loading type dryers, and front loading type dryers depending on systems for introducing the drying object to the dryers. In the top loading type dryers, the drying object is introduced to the dryer from a top thereof, and in the front loading type dryers, the drying object is introduced to the dryer from a front thereof.

However, the related art dryers have the following problems.

In general, the related art dryer dries laundry washed, spun, and introduced thereto. However, in view of nature of washing with water, wrinkles are formed on the washed laundry, and the wrinkles formed thus are not removed perfectly in drying with the dryer. Therefore, in order to remove the wrinkles from a drying object, such as the laundry dried at the related art dryer, pressing is required, additionally.

Moreover, besides the washed laundry, in cases of conventional storage, and use of clothes, wrinkles, crumples, and folds (will be called as crumples, collectively) are formed on the clothes. Accumulation of static electricity caused by friction between clothes during a drying course with hot air is liable to give unpleasant feeling to the user during the clothes is taken out. Development of an appliance has been required, which can make easy removal of the crumples coming from the conventional storage and use of the clothes.

SUMMARY OF THE INVENTION

The present invention is directed to a laundry dryer having a function for preventing wrinkles from forming on laundry.

An object of the present invention is to provide a laundry dryer which can remove static electricity from dried clothes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling a dryer includes a hot air supply step for supplying dried hot air to a drum for drying clothes, and a moisture supply step for supplying moisture to the drum for removing static electricity from the clothes dried in the hot air supply step.

In another aspect of the present invention, a method for controlling a dryer includes spraying fine particles of water or high temperature steam for preventing a drying object from forming wrinkles, supplying dried hot air to a drum, supplying moisture for removing static electricity from the drying object, and cooling the clothes.

The dryer can have a steam generator, thereby permit effective prevention/removal of wrinkles and static electricity from clothes.

Along with this, the present invention can solve the problem of overflow taken place in a course of steam generation for enhancing consumer's satisfaction on the performance of the product.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

In order to describe a laundry machine and a method for controlling the same of the present invention, a top loading, electric, and condensing type dryer will be taken as an embodiment for the sake of convenience. Of course, however, the present invention is not limited to this, but the present invention is applicable to front loading type, gas type, and condensing type dryers.

Figure 1:
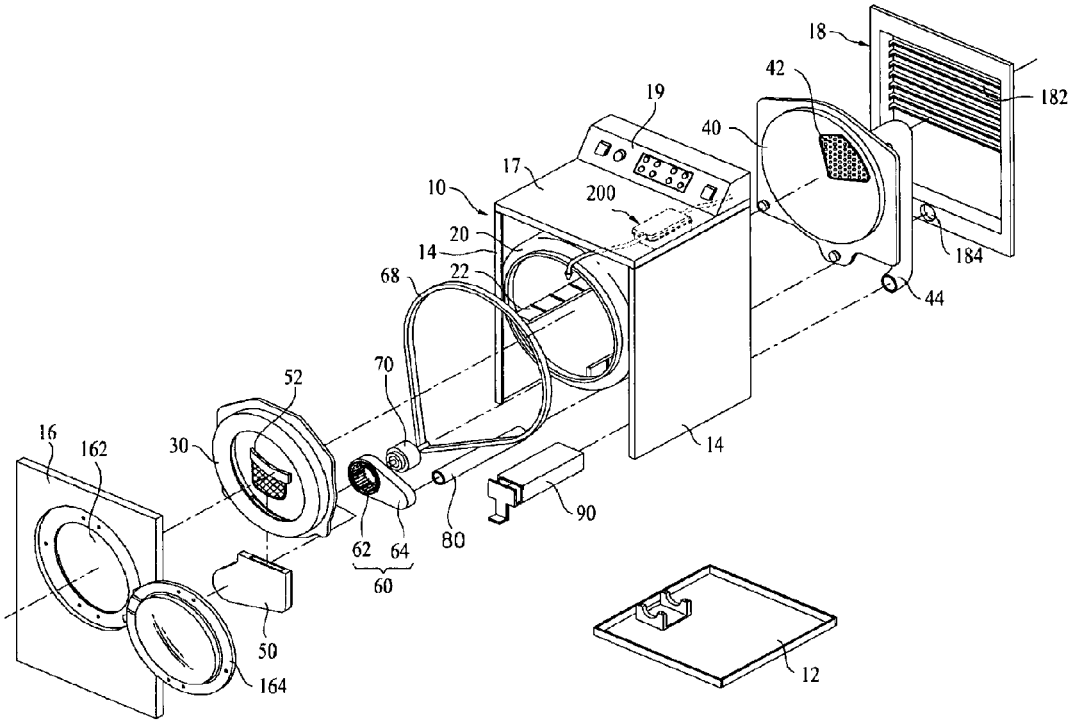
FIG. 1 illustrates an exploded perspective view of a dryer in accordance with a preferred embodiment of the present invention.
Figure 2:
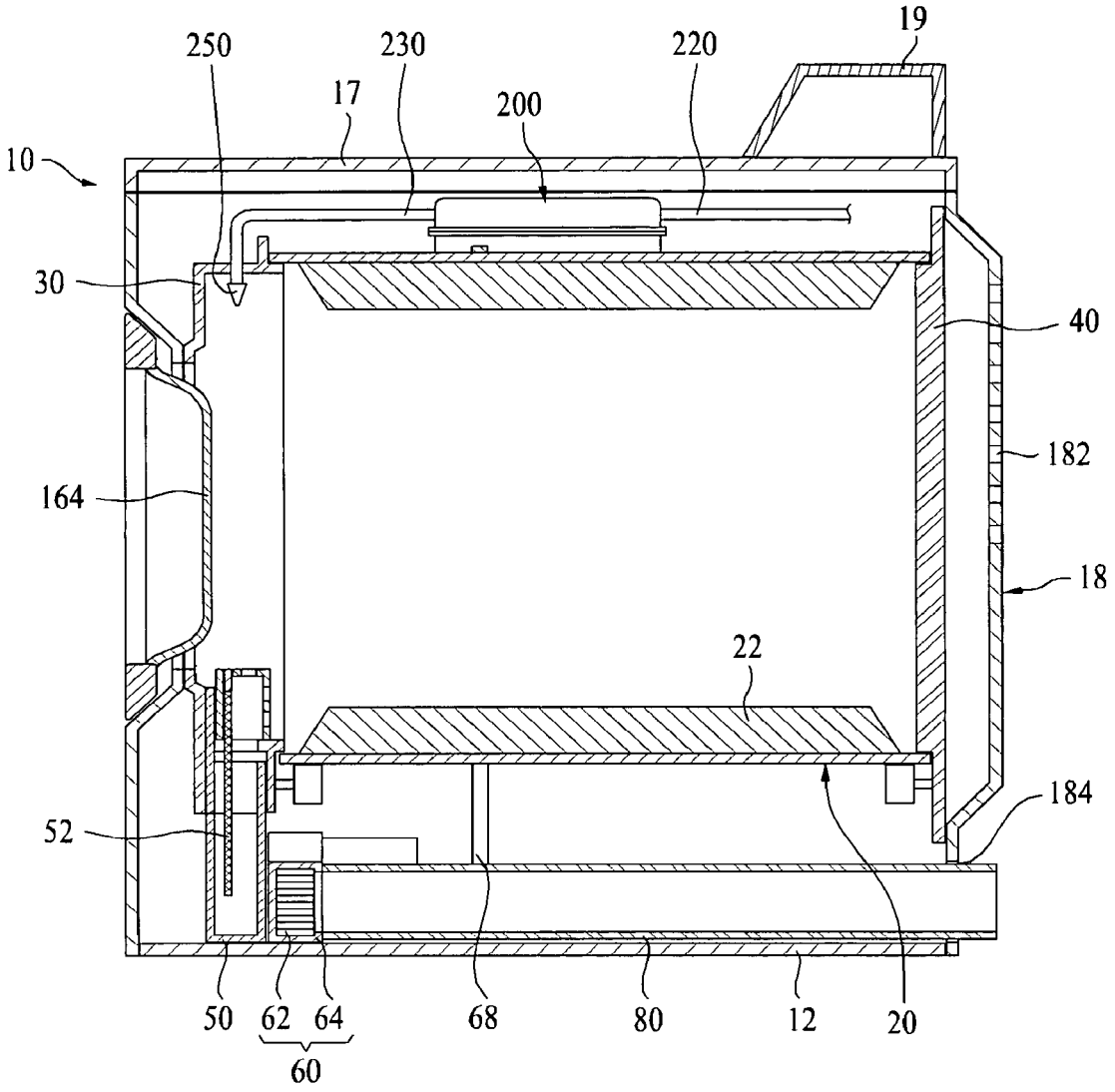
FIG. 2 illustrates a longitudinal section of the dryer in FIG. 1.

A laundry machine and a method for controlling the same in accordance with a preferred embodiment of the present invention will be described with reference to FIGS. 1 and 2.

Inside of a cabinet 10 which forms an exterior of the dryer, there are a rotatable drum 20, a motor 70 and a belt 68 for driving the drum 20. Mounted at a predetermined Locations of the cabinet 10, there are a hot air heater 90 for heating air to produce high temperature air (will be called as hot air), and a hot air supply duct 44 for supplying the hot air from the hot air heater 90 to the drum 20. And, an exhaust duct 80 for discharging humid air heat exchanged with the laundry at the drum 20 and a blower unit 60 for drawing in the humid air is also mounted. In the meantime, mounted at a predetermined location of the cabinet 10, there is a steam generator 200 for generating hot steam. For convenience sake, in the embodiment, though the present invention is shown and described based on an indirect drive type in which the drum 20 is rotated with the motor 70 and the belt 68, the present invention is not limited this, but is also applicable to a direct drive type in which the drum 20 is rotated directly by a motor directly connected to a rear of the drum 20.

Respective elements of the dryer will be described in detail.

The cabinet 10 which forms an exterior of the dryer includes a base 12 which forms a bottom of the dryer, one pair of side covers 14 mounted to the base 12 vertically, a front cover 16 and a rear cover 18 mounted to a front and a rear of the side covers 14 respectively, and a top cover 17 located on top of the side covers 4. A control panel 19 with various operation switches is conventionally located on the Lop cover 17 or the front cover 16. The rear cover 18 has an inlet 182 for introduction of external air, and an exhaust hole 184 which is a final passage for discharging the air from the drum 20 to an outside of the dryer.

An inside space of the drum 20 serves as a drying chamber for drying the clothes, and, it is preferable that lifts 22 are provided in the drum 20 for lifting and dropping clothes, to turn the clothes upside down for enhancing drying efficiency.

In the meantime, mounted between the drum 20 and the cabinet 10 (the front cover 16 and the rear cover 18), there are a front supporter 30 and a rear supporter 40. Rotatably mounted between the front supporter 30 and the rear supporter 40, there is the drum 20, and mounted between the front supporter 30 and the rear supporter 40 and the drum 20, there are sealing members (not shown) for preventing leakage, respectively. That is, the front supporter 30 and the rear supporter 40 respectively cover the front and rear of the drum 20 to form the drying chamber, and serve to support the front and rear of the drum 20, respectively.

The front supporter 30 has an opening to make the drum 20 to be in communication with an outside of the dryer, and the opening has a door 164 for selective opening/closing. The front supporter 30 has a lint duct 50 connected thereto, which is a passage of the air from the drum 20 to an outside of the dryer, with a lint filter 52 mounted thereto. The blower unit 60 has one side connected to the lint duct 50, and the other side connected to the exhaust duct 80 which is connected to the exhaust hole 184 in the rear cover 18. Accordingly, if the blower unit 60 is operated, the air is discharged to an outside of the dryer from the drum 20 through the lint duct 50, the exhaust duct 80, and the exhaust hole 184. In this instance, foreign matters, such as lint, are filtered at the lint filter 52. In general, the blower unit 60 includes a blower 62 and a blower housing 64, and, in general, the blower 64 is driven by the motor 70 which also drives the drum 20.

The rear supporter 40 has an opening portion 42 having, in general, a plurality of pass through holes, with the hot air supply duct 44 connected thereto. The hot air supply duct 44 is in communication with the drum 20 for serving as a passage for supplying the hot air to the drum 20. Accordingly, the hot air heater 90 is mounted to a predetermined location of the hot air supply duct 44.

Figure 3:
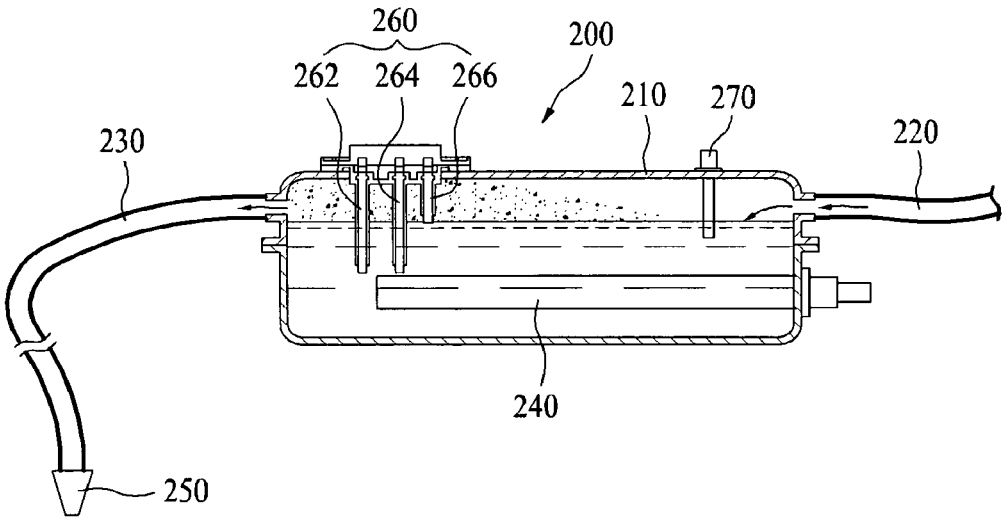
FIG. 3 illustrates a section of a steam generator in FIG. 1.
Figure 4:
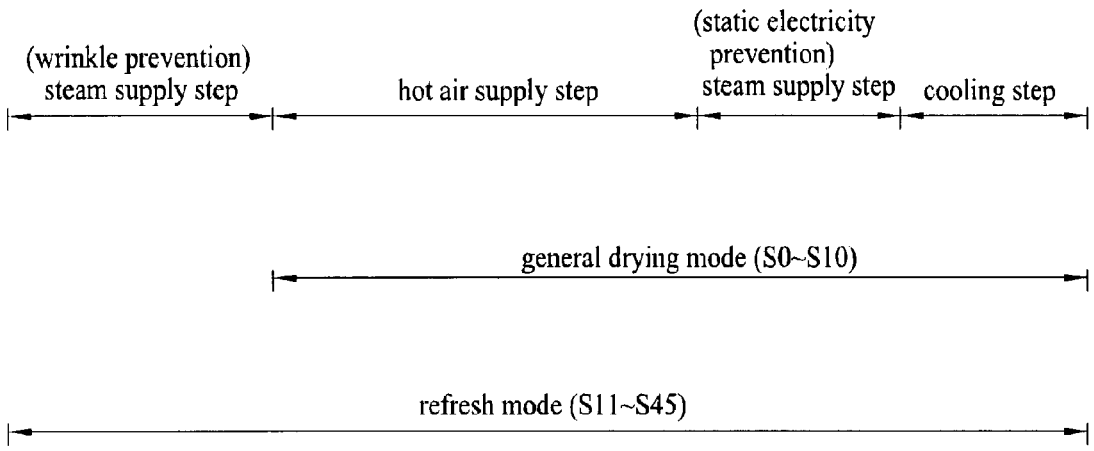
FIG. 4 illustrates a timing chart of entire drying course of a dryer in accordance with a preferred embodiment of the present invention.

In the meantime, mounted to a predetermined location of the cabinet 10, there is the steam generator 200 for generating steam and supplying the steam to the drum 20. The steam generator 200 will be described in detail with reference to FIG. 3.

The steam generator 200 includes a water tank 210 for holding water, a heater 240 mounted to an inside of the water tank 210, a water level sensor 260 for measuring a water level of the steam generator 200, and a temperature sensor 270 for measuring a temperature of the steam generator 200. In general, the water level sensor 260 includes a common electrode 262, a low water level electrode 264, and a high water level electrode 266 for sensing a high water level by electric conduction between the common electrode 262 and the high water level electrode 264 or a low water level by electric conduction between the common electrode 262 and the low water level electrode 266.

The steam generator 200 has one side connected to a water supply hose 220 for supplying water, and the other side connected to a steam hose 230 for discharging steam, and it is preferable that a nozzle 250 of predetermined shape is provided to a fore end of the steam hose 230. In general, one end of the water supply hose 220 is connected to an external water supply source, such as tap, and the fore end or the nozzle 25 of the steam hose 230, i.e., a steam outlet is located at a predetermined location of the drum 20, for spraying the steam to an inside of the drum 20.

In the meantime, though the embodiment shows and describes a steam generator 200 (will be called as a tank heating type for convenience sake) in which an amount of water held in the water tank 210 of a predetermined size is heated with the heater 240 to generate the steam, the present invention is not limited to this. That is, the present invention can use any steam generator as far as the device can generate the steam. For an example, a system may also be used, in which a heater may be directly mounted around a water supply hose through which water passes for heating the water without holding the water within a space (for convenience sake, will be called as a tubular heating system).

A course controlling method for achieving the object of the present invention by using the foregoing dryer will be described, in detail.

The dryer of the present invention provides a variety of modes starting from a general drying mode for drying wet clothes, a refresh mode for removal of wrinkles from, or sterilizing the clothes dried thus, and a static electricity removal mode for removing static electricity from the clothes.

Accordingly, when it is intended to drive the dryer of the present invention, the user is required to select a mode intended to carry out from the plurality of modes, including the general drying mode, the refresh mode, and the static electricity removal mode.

When the user selects the operation mode of the dryer thus, a course of the selected operation mode is performed while supplying hot air or cold air to the drum.

In this case, laundry is dried with high temperature dried hot air, when much static electricity is accumulated due to repetitive friction between clothes such that the user has unpleasant feeling at the time the user takes out the clothes after finish of the drying. Consequently, the dryer of the present invention supplies moisture to the drum for removal of the accumulated static electricity from the clothes.

In a case a mode is selected specifically, an operation method of the selected mode is as follows.

A control method of a general drying mode of the present invention includes a hot air supplying step of supplying dried hot air to the drum for drying the clothes, and a static electricity removal step of supplying moisture for removal of static electricity from the clothes having dried in the hot air supplying step.

A control method of a refresh mode of the present invention includes a steam supply step for spraying high temperature steam for preventing wrinkles from forming on the clothes, a hot air supply step for supplying dried hot air to dry the clothes, and a static electricity removal step for supplying moisture to remove static electricity generated and accumulated due to friction between clothes in the drying step.

If the static electricity removal mode is selected at the dryer of the present invention, the static electricity removal step is included for supplying moisture to remove static electricity accumulated on the clothes.

In the meantime, because overflow from the steam generator 200 to the drum in a course of boiling of water at an initial heating is liable to impair a drying performance, a course control for minimizing splash of the water on the dried clothes is provided.

A method for controlling a dryer of the present invention will be described in more detail.

Figure 5:
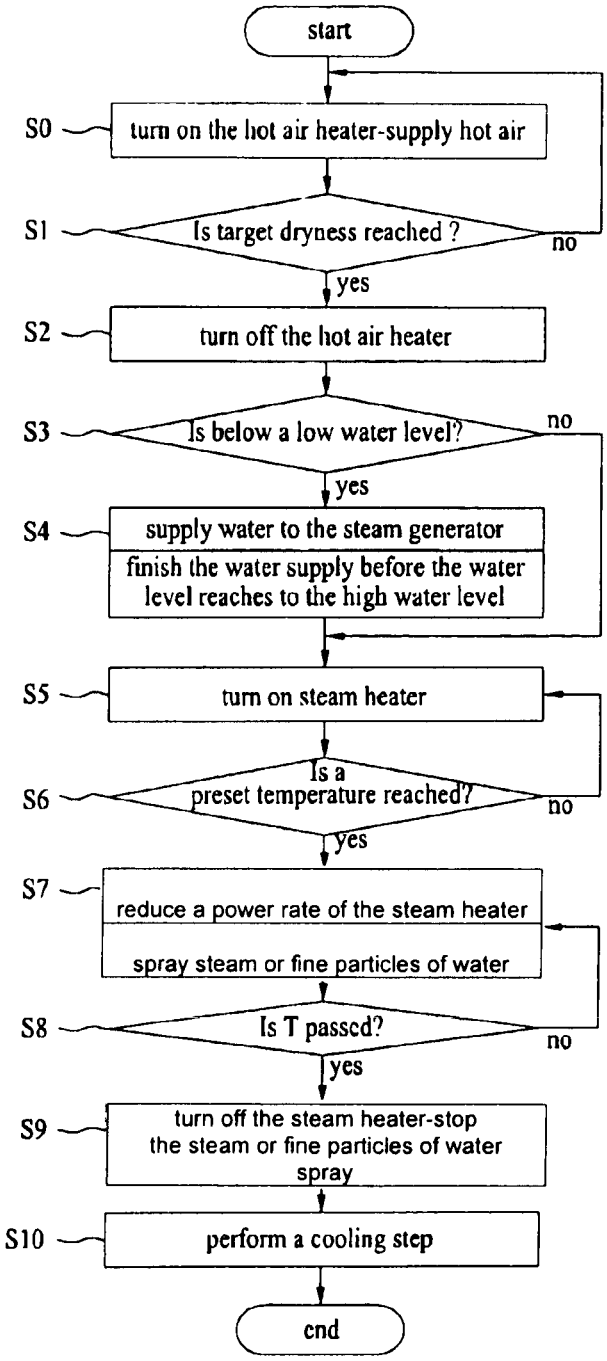
FIG. 5 illustrates a flow chart showing the steps of a general drying mode in accordance with a preferred embodiment of the present invention.

Referring to FIG. 5, the general drying mode of the present invention will be described.

If a drying course is started, the hot air heater 90 is put into operation, and air in the drum 20 is heated with the hot air heater 90 (S0) (hereafter called as hot air supply step).

In a course of performing the hot air supply step, the high temperature dried hot air keeps circulating through inside/outside of the drum 20 to dry moisture from the clothes.

A humidity sensor (not shown) is used for sensing a degree of dryness of the clothes during the hot air supply step is performed. That is, the degree of dryness of the clothes can be determined with reference to the humidity level sensed at the humidity sensor.

Of course, the sensing of dryness of the clothes is not limited to use of the humidity sensor, but a time period for performing the hot air supply step may be set indirectly by using an experimentally determined time period setting, or amount of clothes.

When the dryness of the clothes reaches to target dryness, the hot air heater is turned off 90, to finish the hot air supply step (S1, S2).

If drying of the clothes is finished by using the hot air supply step, a water level of the steam generator 200 is sensed (S3).

If the water level of the steam generator 200 does not reach even to the low water level electrode 264, water is supplied to the steam generator 200 (S4) (hereafter called as a water supply step).

Figure 6:
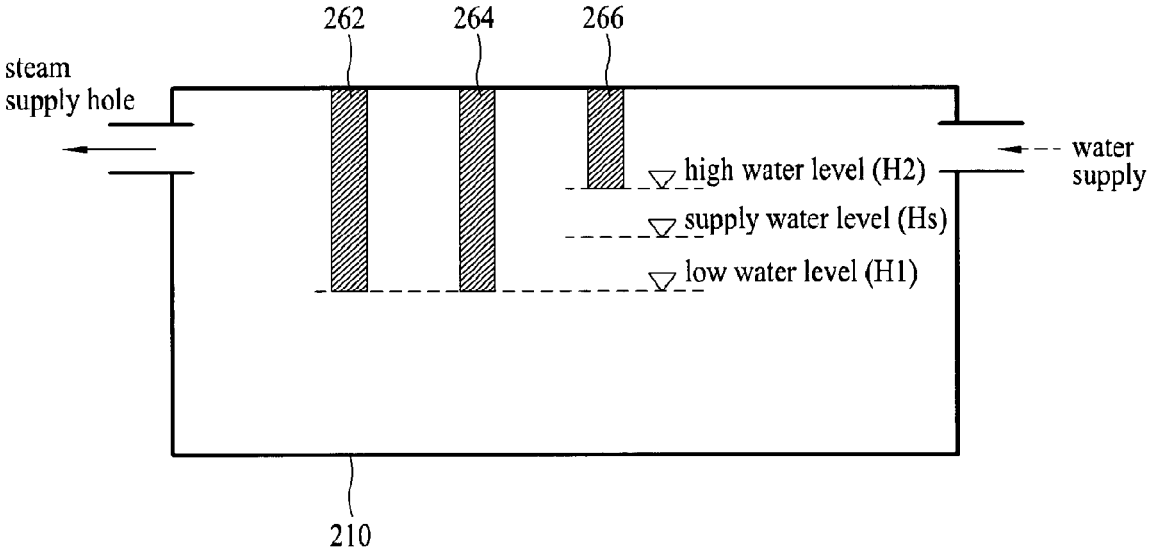
FIG. 6 illustrates a section showing levels water supply of a steam generator.

Referring to FIG. 6, it is preferable that a water supply level Hs in the water supply step is higher than the low water level H1 and lower than the high water level H2 for preventing overflow from taking place.

That is, in the course of performing the water supply step, after water is supplied to the water level reached to the low water level electrode 264, the water supply stops before the water level reaches to the high water level electrode 266. For an example, if it is assumed that a time period required for the water level to reach from the low water level H1 to the high water level H2 is one minute, the water supply is kept for approx. 10 seconds starting from a time point when the water level reaches to the low water level electrode 264, and the water supply stops after 10 seconds.

In the meantime, if the water level of the steam generator 200 is sensed to be higher than the low water level H1, it is preferable that the water supply step is omitted, and water remained in the steam generator 200 is used.

When the water supply to the steam generator 200 is resolved, the steam heater 240 is put into operation (S5). In this instance, it is preferable that the steam heater 240 is operated at a highest electric power rate of the steam heater 240.

Then, if an inside temperature of the steam generator 200 reaches to a preset temperature (for an example, 100° C.) owing to the steam heater 240, high temperature steam is sprayed into the drum 20 for removing static electricity from the dried clothes (S6, S7) (hereafter called as a steam supply step).

It is preferable that the electric power rate of the steam heater 240 is reduced for a preset time period (for an example, 3 minutes) for preventing overflow from taking place at a time point when the inside temperature of the steam generator 200 reaches to a preset temperature.

In this instance, in the steam supply step, the electric power rate of the steam heater may be set to be an half of the highest electric power rate, or a power rate at which no bubble is formed, which is caused by vaporization in a course of boiling of the water in the steam generator 200.

If the preset time period is passed, in which the electric power rate of the steam heater 240 is reduced, the steam spray is kept on again with the electric power rate of the steam heater 240 restored.

Then, if the preset time period T of the steam supply step is passed, operation of the steam heater 240 is stopped, and the steam supply step is ended (S8, S9).

If the steam supply step is ended, the air is circulated through the inside/outside of the drum in a state the hot air heater 90 is turned off to perform a cooling step for cooling the clothes (S10).

In the water supply step in the embodiment, the water is not supplied up to the high water level H2 or the water supply is omitted in a case water is remained at a level higher than the lower water level H1, for preventing overflow of boiling water into the drum 20 in the steam generating step in advance.

The reduction of the electric power rate of the steam heater 240 for the preset time period in the moisture generating step can also prevent the overflow from the steam generator 200 to the drum 20.

For preventing the overflow in the embodiment, though it is shown and described that both the water supply amount control for the steam generator 200, and the electric power rate control for the steam heater 240 are used, methods for preventing the overflow is not limited to this, but one of the two methods may be used, selectively.

Or, alternatively, for the same purpose, the water in the steam generator 200 may be overflowed in advance before the clothes are dried.

In this case, the water supply required in the steam supply step is performed before the hot air supply step, and, for an example, the steam heater 240 is operated for a preset time period (for an example, 4 minutes) in the middle of the hot air supply step for making the water in the steam generator 200 to overflow. It is preferable that the preset time period is set to be longer than a time period required for formation of bubbles owing to vaporization in a course of water boiling. It is also preferable that a time point when the steam heater 240 is turned on for making the overflow is set to be a time point when the hot air heater 90 is turned on in the hot air supply step.

Accordingly, if the steam supply step is started, the steam is generated from the water remained in the water tank 210 without additional water supply. Because the water level of the steam generator 200 is dropped adequately already in the hot air supply step by the overflow, at the time of steam generation, the drying performance impaired by the overflow can be prevented.

In the meantime, in the general drying mode, the steam supply step is performed again after the hot air supply step, in which, instead of the high temperature steam, moisture, preferably, moisture of fine particles may be supplied on a purpose of static electricity prevention. Accordingly, the steam supply step for prevention of the static electricity is a static electricity removal step by means of supply of moisture, actually.

Moreover, as described before, the steam supply step is the same with the static electricity removal step by means of supply of moisture, actually. Therefore, it is preferable that the steam supply step for supplying moisture for removing the static electricity further includes the hot air/cold air supply steps for supplying hot air or the cold air for drying the clothes. This is for prevention of the clothes from wetting with the moisture supplied in the steam supply step (i.e., the static electricity removal step).

In the meantime, it is preferable that the hot air/cold air supply step is shorter than a time period of the steam supply step. In detail, it is preferable that the hot air/cold air supply step is performed only for a time period in which no static electricity is accumulated on the clothes by friction. That is, clothes are dried by supplying the cold air or the hot air only for a time period in which the static electricity is not accumulated again on the clothes having the static electricity removed therefrom by supply of the moisture.

In the meantime, the hot air/cold air supply step is applicable not only to the general drying mode, but also to the refresh mode and the static electricity removal mode. That is, alike to the general drying mode, since the refresh mode and the static electricity removal mode also has the moisture supply step (the static electricity removal step) for supplying moisture for removal of the static electricity, as described before, it is preferable that the moisture supply step includes the hot air/cold air supply step.

Figure 7:
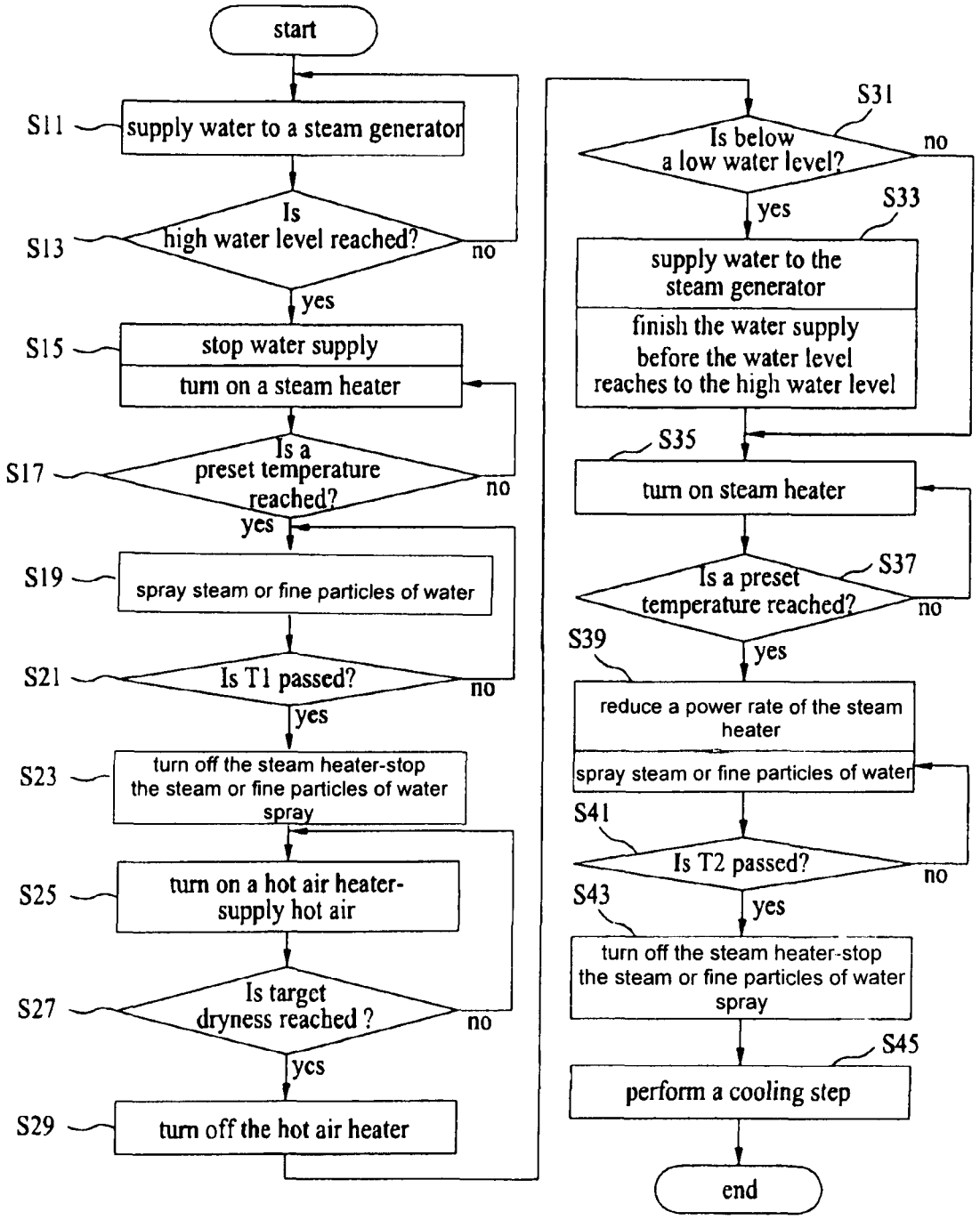
FIG. 7 illustrates a flow chart of the steps of a refresh mode in accordance with a preferred embodiment of the present invention.

FIG. 7 illustrates a flow chart of the steps of a control method of the refresh mode. The refresh mode of the present invention will be described with reference to FIG. 7.

When the drying course is started, water is supplied to the steam generator 200 (S11) (hereafter called as a first water supply step).

In the first water supply step, water is supplied until the water level reaches to the high water level electrode 266 of the water level sensor 260, when the first water supply step ends, and the steam heater 240 is turned on (S13, S15).

A water temperature of the water tank 210 rising owing to heat generation of the steam heater 240 is sensed with the temperature sensor 270, and if the water temperature reaches to the preset temperature (for an example, 100° C.), high temperature steam is sprayed into the drum 20 (S17, S19) (hereafter called as a steam supply step).

The steam supply step is a step in which high temperature steam is supplied into the drum 20 mostly for removal of wrinkles from, and sterilizing, the laundry.

If the preset course time period (T1) of the steam supply step is passed, the steam heater 240 is turned off and the steam supply step is ended (S21, S23).

The hot air heater 90 is turned on at the time the steam supply step is ended, for heating the air flowing in the drum 20 (S25) (hereafter called as a hot air supply step).

In a course of performing the hot air supply step, the hot dry hot air keeps circulating through inside/outside of the drum 20 to dry the moisture in the clothes.

In order to sense a degree of dryness of the clothes during the hot air supply step is performed, a humidity sensor (not shown) is used. That is, the degree of dryness of the clothes can be determined with reference to a humidity level sensed with the humidity sensor.

Once the dryness of the clothes reaches to target dryness, the hot air heater 90 is turned off to finish the hot air supply step (S27, S29).

If drying of the clothes is finished in the hot air supply step, the water level of the steam generator 200 is sensed (S31).

If the water level of the steam generator 200 does not reach even to the low water level electrode 264, the water is supplied to the steam generator 200 up to the water supply level Hs (S33) (hereafter called as a second water supply step).

It is preferable that the water supply level Hs is set to be higher than the low water level Hl and lower than the high water level H2.

In the meantime, if the water level of the steam generator 200 is sensed to be higher than the low water level, the second water supply step is omitted, to utilize the water left in the steam generator 200 from the first water supply step.

If the water supply to the steam generator 200 is resolved, the steam heater 240 is put into operation again (S35).

Then, if an inside temperature of the steam generator 200 heated by the steam heater 240 reaches to a preset temperature (for an example, 100° C.), high temperature steam is sprayed into the drum 20 for removing static electricity from the dried clothes (S37, S39) (hereafter called as a static electricity removing step).

It is preferable that a power rate of the steam heater 240 running presently is reduced for a certain time period (for an example, 3 minutes) at the time the inside temperature of the steam generator 200 reaches to the preset temperature.

In this instance, the power rate of the steam heater in the static electricity removing step may be set to be ½ of the power rate of the steam heater in the steam supply step, or may be set as a power rate which can provide power just before forming bubbles owing to evaporation in a course of boiling of the water in the steam generator 200.

If the certain time period is passed, in which the power rate of the steam heater 240 is reduced in the static electricity removing step, the steam spray is kept on with a restored power rate of the steam heater 240.

Then, if the preset course time period T2 of the moisture supply step is passed, the steam heater 240 is turned off and the static electricity removing step is ended (S41, S43).

If the static electricity removing step ends, the air circulated through the outside/inside of the drum 20 in a state the hot air 90 is turned off, to perform a clothes cooling step in which the clothes are cooled (S45).

In the refresh mode too, the steam is supplied once again before the cooling step for preventing the static electricity from forming after the hot air supply step, when the steps the same with the general drying mode can be applied for preventing overflow from the steam generator 200 at the time of steam supply.

Therefore, the present invention can remove the static electricity from the dried clothes by performing the steam generating step once again before performing the cooling step.

Moreover, as described before, it is preferable that the static electricity removing step (a moisture supplying step) includes a hot air/cold air supply step. By this, wetting of the clothes with the moisture supplied in the static electricity removing step can be prevented.

Moreover, by making the water overflow from the steam generator in advance, reducing a water supply level of the steam generator, or reducing the power rate of the steam heater in the hot air supply step, the overflow can be prevented in the steam generating step for removing the static electricity.

In the meantime, the static electricity removing mode is different from the general drying mode, and the refresh mode only in that the moisture is supplied for removing the static electricity. In this case, as described before, it does not matter even if moisture, preferably, fine particles of moisture is supplied, instead of the high temperature steam. Moreover, as described before, it is preferable that the static electricity removing step includes the hot air/cold air supply step.

As has been described, the method for controlling a laundry dryer of the present invention has the following advantages.

First, the dryer of the present invention which can provide high temperature steam permits to prevent wrinkles from forming on the dried drying object and sterilize the drying object, effectively.

Second, the removal of the static electricity before the cooling step after drying of the clothes is finished permits to minimize user's unpleasant feeling, thereby enhancing user's satisfaction on the product.

Third, a maximum drying performance can be maintained by preventing overflow from the steam generator from taking place so that there is no wetting of the dried clothes with the moisture in the step for removing the static electricity.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method for controlling a dryer comprising:

receiving a mode selection in a dryer having a drying mode and a refresh mode;

performing a hot air supplying step by supplying dried hot air to a drum for drying clothes and a static electricity removal step by spraying fine particles of water or steam to the drum for removal of static electricity from the clothes having dried in the hot air supplying step, when a selected mode is the drying mode; and performing a refreshing clothes step by spraying fine particles of water or steam to the drum for preventing wrinkles from forming on the clothes, a hot air supplying step by supplying dried hot air to the drum for drying the clothes after the refreshing clothes step, and a static electricity removal step by spraying fine particles of water or steam to the drum for removal static electricity generated and accumulated due to friction between clothes in the drying step, when the selected mode is the refresh mode, wherein the hot air supplying step in both the drying mode and the refresh mode includes a steam generator overflowing step for causing water in the steam generator to overflow into the drum during the supply of hot air.

2. The method as claimed in claim 1, wherein the removing static electricity step includes supplying hot air to dry the clothes.

3. The method as claimed in claim 1, wherein the steam is generated in the steam generator independently from the hot air generated in a hot air heater and supplied to the drum independently from the hot air.

4. The method as claimed in claim 3, further comprising:

heating water in the steam generator until a preset temperature is reached.

5. The method as claimed in claim 4, wherein the spraying of steam or fine particles of water is done for a preset course time period before the steam heater is turned off.

6. The method as claimed in claim 4, wherein the spraying of steam or fine particles of water in the removing static electricity step includes dropping a power rate of the steam heater of the steam generator when an inside temperature of the steam generator reaches the preset temperature.

7. The method as claimed in claim 6, wherein the dropping the power rate includes setting the power rate of the steam heater to ½ of a maximum power rate.

8. The method as claimed in claim 6, wherein the dropping a power rate includes setting the power rate of the steam heater to a power rate range in which no bubbles caused by vaporization in a process of boiling of the water are formed.

9. The method as claimed in claim 3, wherein the spraying of steam or fine particles of water includes supplying water to the steam generator when a low water level in the steam generator is sensed.

10. The method as claimed in claim 9, wherein the supplying of water to steam generator includes supplying water for a preset time period after a water level in the steam generator reaches the low water level.

11. The method as claimed in claim 10, wherein the preset time period is set to be as short as the water level does not reach a high water level.

12. The method as claimed in claim 1, wherein cold air is supplied to the drum after the removing static electricity step to cool the clothes.

13. The method as claimed in claim 1, wherein water is prevented from overflowing to the drum during the spraying of fine particles of water or steam by regulating a steam generator's water level and a power rate to a steam heater in the steam generator.

* * * * *